United States Patent [19]

Fisher

[11] 4,051,077

[45] Sept. 27, 1977

[54] NON-FILMING DUAL ADDITIVE DEVELOPER

[75] Inventor: Donald J. Fisher, Pittsford, N.Y.

[73] Assignee: Xerox Corporation, Stamford, Conn.

[21] Appl. No.: 544,095

[22] Filed: Jan. 27, 1975

Related U.S. Application Data

[62] Division of Ser. No. 445,389, Feb. 25, 1974, Pat. No. 3,900,588.

[51] Int. Cl.[2] ..... G03G 9/00

[52] U.S. Cl. ..... 252/62.1 P; 96/1 SD

[58] Field of Search ..... 96/1 SD; 252/62.1; 427/19, 14

[56] References Cited

U.S. PATENT DOCUMENTS

| | | | |
|---|---|---|---|
| 3,558,492 | 1/1971 | Praokow | 252/62.1 P |
| 3,819,367 | 6/1974 | Chatterji | 96/1 SD |
| 3,893,934 | 7/1975 | Braun | 96/1 SD |

*Primary Examiner*—David Klein
*Assistant Examiner*—John L. Goodrow
*Attorney, Agent, or Firm*—James J. Ralabate; Eugene O. Palazzo; James H. Laughlin

[57] ABSTRACT

An imaging technique and composition for developing electrostatographic latent images is given whereby a developer composition is employed comprising toner, a substantially smearless polymeric additive, and an abrasive material.

13 Claims, No Drawings

NON-FILMING DUAL ADDITIVE DEVELOPER

This is a division of application Ser. No. 445,389, filed Feb. 25,1974, now U.S. Pat. No. 3,900,588,

BACKGROUND OF THE INVENTION

This invention relates to imaging systems, and more particularly, to improved electrostatographic developing materials, their manufacture and use.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layers exposed to the light and developing the resulting electrostatic latent image by depositing on the image a finely divided electroscopic material referred to in the art as "toner." The toner will normally be attracted to those areas of the layer which retain a charge thereby forming a toner image corresponding to the electrostatic latent image. This powder image may then be transferred to a support surface such as paper. The transferred image may substantially be permanently affixed to the support surface as by heat. Instead of latent image formation by uniformly charging the photoconductive layer and then exposing the layer to a light and shadow image, one may form the latent image by directly charging the layer in image configuration. The powder image may be fixed to the photoconductive layer if the powder image transfer step is not desired. Other suitable fixing means such as solvent or overcoating treatment may be substituted for the foregoing heat fixing step.

Several methods are known for applying the electroscopic particles to the electrostatic latent image to be developed. One development method, as disclosed by E. N. Wise in U.S. Pat. No. 2,618,552 is known as "cascade" development. In this method, a developer material comprising relatively large carrier particles having finely divided toner particles electrostatically coated thereon is conveyed to and rolled or cascaded across the electrostatic image bearing surface. The composition of the carrier particles is so selected as to triboelectrically charge the toner particles to their desired polarity. As the mixture cascades or rolls across the latent image bearing surface, the toner particles are electrostatically deposited and secured in positive development processes to the charged portion of the latent image and are not deposited on the uncharged or background portions of the image. Most of the toner particles accidentally deposited in the background areas are removed by the rolling carrier, due apparently, to the greater electrostatic attraction between the toner and the carrier than between the toner and the discharged background. The carrier and excess toner are then recycled. This technique enhances development of line copy images.

Another method for developing electrostatic images is the "magnetic brush" process as disclosed, for example, in U.S. Pat. Nos. 2,874,063. In this method, a developer material containing toner particles and magnetically attractable carrier particles are carried by a magnet. The magnetic field of the magnet causes alignment of the magnetically attractable carrier particles into a brushlike configuration. This "magnetic brush" is engaged with the electrostatic image bearing surface and the toner particles are drawn from the brush to the latent image by electrostatic attraction.

Still another technique for developing electrostatic latent images is the "powder cloud" process as disclosed, for example, by C. F. Carlson in U.S. Pat. No. 2,221,776.

Other development methods such as "touchdown" development as disclosed by R. W. Gundlach in U.S. Pat. No. 3,166,432 may be used where suitable.

Generally, commercial electrostatographic development systems utilize automatic machines. Since automatic electrostatographic imaging machines should operate with a minimum of maintenance, the developer employed in the machines should be capable of being recycled through many thousands of cycles. In automatic xerographic equipment, it is conventional to employ an electrostatographic plate which is charged, exposed and then developed by contact with a developer mixture. In some automatic machines, the toner image formed on the electrostatographic plate is transferred to a receiving surface and the electrostatographic plate is then cleaned for reuse. Transfer is effected by a corona generating device which imparts an electrostatic charge to attract the powder from the electrostatographic plate to the recording surface. The polarity of charge required to effect image transfer is dependent upon the visual form of the original copy relative to the reproduction and to the electroscopic characteristics of the developing material employed to effect development. For example, where a positive reproduction is to be made of the positive original, it is conventional to employ a positive corona to effect transfer of a negatively charged toner image to the recording surface. When a positive reproduction from a negative original is desired, it is conventional to employ positively charged toner which is repelled by the charged areas on the plate to the discharge areas thereon to form a positive image which may be transferred by negative polarity corona. In either case, a residual powder image usually remains on the image after transfer. Because the plate may be reused for a subsequent cycle, it is necessary that the residual image be removed to prevent further charging and redevelopment of the same image. In a positive to positive reproduction process described above, the residual powder is tightly retained on the plate surface by a phenomenon not fully understood which prevents complete transfer of the powder to the support surface, particularly in the image area. Incomplete transfer of toner particles is undesirable because image density of the ultimate copy is reduced and highly abrasive photoreceptor cleaning techniques are required to remove the residual toner from the photoreceptor surface. This imaging process is ordinarily repeated from each copy reproduced by the machine any time during the resuable life of the developer and the electrophotographic plate surface.

Various electrostatographic plate cleaning devices such as the "brush" and the "web" cleaning apparatus are known in the prior art. A typical brush cleaning apparatus is disclosed by L. E. Walkup et al. in U.S. Pat. No. 2,832,977. The brush type cleaning means usually comprises one or more rotating brushes, which remove residual powder from the plate into a stream of air which is exhausted through a filtering system. A typical web cleaning device is disclosed by W. E. Graff, Jr. et al. in U.S. Pat. No. 3,186,838. As disclosed by Graff, Jr. et al., removal of the residual powder on the plate is effected by passing a web of fibrous materials over the plate surface. Another useful system for removing residual toner particles from the surface of a photoreceptor comprises a flexible cleaning blade which wipes, scrapes, or otherwise removes the residual toner from the photoreceptor surface as the surface moves past the blade.

The foregoing cleaning systems do not, however, remove all types of toner particles from all types of reusable photoreceptors. This is not a shortcoming of the cleaning system by itself. If a particular toner would not tend to form an adherent residual film on a particular photoreceptor, the cleaning systems described would effectively remove all residual toner. However, many commercial toners of their very nature do tend to form a residual film on reusable photoreceptors and such films are undesirable because their presence adversely affects the quality of the undeveloped and developed images. The toner film problem is particularly acute in high speed copying and duplicating machines where contact between the developer and the imaging surface occurs a great many more times and at a higher velocity than in conventional electrostatographic systems. Ultimately, the toner buildup becomes so great that effective copying or duplicating is impaired.

In such systems there is a continuing need to have developers which exhibit high, long term triboelectric stability, while at the same time assisting in the elimination of buildup of toner film.

SUMMARY OF THE INVENTION

Accordingly, it is an object of the invention to provide a developer composition which assists in the elimination of toner film buildup.

It is another object of the invention to provide a developer composition which improves solid area print density.

It is a further object of the invention to provide a developer composition which reduces background density of copies.

It is yet another object of the invention to provide a developer composition having enhanced and stabilized triboelectric characteristics.

Other object and advantages will be found from a full and complete understanding of the invention.

The above objects and others are surprisingly accomplished by providing an electrostatographic developing composition comprising particles; said particles including (1) a finely divided electroscopic toner material; (2) a minor portion, based upon the weight of said toner material, of a stable, tough, substantially smearless, polymeric additive, and (3) a minor portion, based upon the weight of said toner material, of a finely divided nonsmearable abrasive material having a hardness greater than said polymeric additive and said toner material.

Thus, the developer composition of the present invention comprises three constituents, a toner material and a dual additive comprising a substantially smearless polymeric material and a finely divided abrasive type material.

Other objects of the invention are accomplished through a cyclic imaging and development process comprising forming an electrostatic latent image on an imaging surface and forming a developed image by contacting said imaging surface with an electrostatographic developing mixture comprising particles, said particles including (1) finely divided electroscopic toner material, (2) a minor proportion based on the weight of said toner of a tough, stable, substantially smearless polymeric additive material, and (3) a minor proportion based on the weight of said toner material of a finely divided, nonsmearable, abrasive material of a hardness greater than said friction-reducing and toner materials; removing at least a portion of at least any residual developed image from said imaging surface by a force which causes the developer mixture to be wiped across at least a portion of said imaging surface; and repeating the process sequence at least one additional time.

The toner material of the present invention may be any electroscopic toner material which preferably is pigmented or dyed. Typical toner materials include polystyrene resin, acrylic resin, polyethylene resin, polyvinyl chloride resin, polyacrylamide resin, methacrylate resin, polyethylene terephthalate resin, polyamide resin, and copolymers, polyblends, and mixtures thereof. Vinyl resins having a melting point or melting range starting at least about 110° F are especially suitable for use in the toner of this invention. These vinyl resins may be a homopolymer or a copolymer of two or more vinyl monomers. Typical monomeric units which may be employed to form vinyl polymers include: styrene, vinyl naphthalene, mono-olefins, such as, ethylene, propylene, butylene, isobutylene and the like, vinyl esters, such as vinyl acetate, vinyl propionate, vinyl benzoate, vinyl butryrate and the like, esters of alphamethylene aliphatic monocarboxylic acids such as methyl acrylate, ethyl acrylate, n-butyl acrylate, isobutyl acrylate, dodecyl acrylate, n-octyl acrylate, methyl methacrylate, ethyl methacrylate, butyl methacrylate and the like; vinyl ethers such as vinyl methyl ether, vinyl isobutyl ether, vinyl ethyl ether, and the like; vinyl ketones such as vinyl methyl ketone, vinyl hexyl ketone, methyl isopropyl ketone and the like; and mixtures thereof. Suitable materials employed as the toner will usually have an average molecular weight between about 3,000 to about 500,000.

Any suitable pigment or dye may be employed as the colorant for the toner particles. Toner colorants are well known and include, for example, carbon black, nigrosine dye, aniline blue, Calco Oil Blue, chrome yellow, ultramarine blue, duPont Oil Red, quinoline yellow, methylene blue chloride, phthalocyanine blue, Malachite Green Oxalate, lamp black, Rose Bengal and mixtures thereof. The pigment or dyes should be present in the toner in a sufficient quantity to render it highly colored so that it will form a clearly visible image on a recording member. Thus, for example, where conventional xerographic copies of typed documents are desired, the toner may comprise a black pigment such as carbon black or a black dye such as Amaplast Black Dye available from the National Aniline Products, Incorporated. Preferably, the pigment is employed in an amount of from about 1 percent to about 30 percent, by weight, based on the total weight of the colored toner. If the toner colorant employed is a dye, substantially smaller quantities of the colorant may be used.

The additives may be introduced into the ultimate developer material in any suitable manner to form a physical mix of additive particles with developing material particles. Thus, for example, the additive particles may be initially mixed with carrier particles or toner particles and thereafter introduced into the developer mix. Generally, when the additives are physically mixed with toner or carrier particles, satisfactory results are achieved when about 0.11 to about 15 percent additives based on the weight of the toner particles is employed. Greater cleaning efficiency at reduced cleaning pressures is achieved when the additives are present in an amount from about 0.1 percent to about 5 percent based on the weight of the toner in the final developer mixture.

Any suitable stable, tough, smearless, solid, polymeric additive having a Rockwell hardness (ASTM Test D/785) of at least about R-10 may be employed in the developer of this invention. Undesirable filming of the additive is inhibited by employment of tough additive particles having a Rockwell hardness of about R-10. If desired, additive materials having a Rockwell hardness as high as about R-120 may be utilized to form the developer of this invention. Generally, the additive particles have an average particle size less than about the particle size of the toner particles. An average particle size from about 0.05 to about 30 microns is preferred because more copies of higher quality images may be obtained. Particularly good results are obtained with an average particle size range from about 0.20 micron to about 8 microns because efficient cleaning is achieved without adversely affecting image density as a result of additive particles present in transferred toner images. The additives of this invention may be of any suitable shape. Typical shapes include flake, cylindrical, spherical, granular and irregular particles. Optimum results are obtained with additive particles having a spherical shape because more effective removal of residual toner particles at lower cleaning pressures is achieved, particularly with a blade cleaning system.

Generally, polymeric additive materials more electronegative than sulfur are preferred because a greater number of higher quality images can be obtained on reusable photoreceptors with scraping devices such as doctor blades. Whether a material is more electronegative than sulfur may be determined by known techniques such as by determining the position of the additive material relative to sulfur in a triboelectric series. The materials in a triboelectric series are arranged in such a way that each material is charged with positive electricity when contacted with any material below it in the series and with negative electricity when contacted with any material above it in the series. Thus any material which acquires a negative charge when contacted with sulfur may be considered more electronegative than sulfur and obviously would be below sulfur in the triboelectric series.

Typical stable, solid, polymeric additive materials below sulfur in the triboelectric series include: polyvinylidene fluoride, polytetrafluoroethylene, polychlorotrifluoroethylene, polyvinyl fluoride, polyvinylchloride, polyvinylidine chloride, polyethylene, polypropylene, chlorinated polyethylene, chlorinated polyether, copolymers of tetrafluoroethylene and chlorotrifluoroethylene, copolymers of tetrafluoroethylene and hexafluoropropylene, copolymers of tetrafluoroethylene and vinylidine fluoride, copolymers of chlorotrifluoroethylene and vinylidine fluoride, copolymers of vinyl chloride and vinyl fluoride, copolymers of vinyl chloride and polyethylene, copolymers of vinyl chloride and polypropylene and mixtures of any of the above homopolymers or copolymers. Homopolymers or copolymers of fluoro-olefins detailed above are preferred because a greater number of high quality copies can be obtained on a reusable photoreceptor surface.

The combination of the resin component, colorant, polymeric additive and abrasive additive, whether the resin component is a homopolymer, copolymer or blend, should have a blocking temperature of at least about 110° F. When the toner is characterized by a blocking temperature less than about 110° F. the toner particles tend to agglomerate during storage and machine operation and also from undesirable films on the surface of reusable photoreceptors which adversely affect image quality.

The toner compositions of the present invention may be prepared by any well-known toner mixing and comminution technique. For example, the ingredients may be thoroughly mixed by blending, mixing and milling the components and thereafter micropulverizing the resulting mixture. Another well-known technique for forming toner particles is to spray-dry a ball-milled toner composition comprising a colorant, a resin and a solvent. When the toner mixtures of this invention are to be employed in a cascade development process, the toner should have an average particle size by weight percent less than about 30 microns and preferably between about 4 and about 20 microns for optimum results.

Preferably, the additives of this invention are selected from materials having a lower critical surface tension than the critical surface tension of the toner employed therewith. Normally, a difference in critical tension value of at least about two dynes per centimeter between the toner and the additive is preferred for optimum cleaning and image quality. Good results are obtained with developer material comprising colored toner particles having a critical surface tension value greater than about 24 dynes per centimeter in combination with additives having a critical surface tension value less than about 33 dynes per centimeter. Typical polymeric materials having a critical surface tension value less than about 33 dynes per centimeter include: polyvinylidine fluoride, polytetrafluoroethylene, polychlorotrifluoroethylene, polyvinyl fluoride, copolymers of tetrafluoroethylene and chlorotrifluoroethylene, copolymers of tetrafluoroethylene and hexafluoropropylene, copolymers of chlorotrifluoroethylene and vinylidene fluoride, and mixtures thereof. Excellent results are obtained with polyvinylidine fluoride. Developers containing polyvinylidine fluoride additives form the greatest number of dense background free images on reusable imaging surfaces.

A number of pigmented or dyed electroscopic toner material having a critical surface tension value greater than about 24 dynes per centimeter are described in the patent literature. Typical toner materials having a critical surface tension value greater than about 24 dynes per centimeter include polystyrene resin, acrylic resin, polyethylene resin, polyvinyl chloride resin, polyacrylamide resin, methacrylate resin, polyethylene terephthalate resin, polyamide resin, polyamide epichlorohydrin resin, resinous condensation product of 2,2 bis (4-hydroxy-isopropoxy-phenyl) - propane and fumaric acid, and copolymers, polyblends and mixtures thereof.

The critical surface tension values of many solid surfaces are well known. For further details as to the determination of the critical surface tension of a solid surface, reference is made to the discussion in the Journal of Colloid Science, Vol. 7, 1952 beginning at page 109. The critical surface tension values employed herein are based on measurements made between about 20° C and about 25° C.

With no intention of being bound by any theory of action, it is believed that the use of a tough, stable, substantially smearless polymeric additive material with a nonsmearing abrasive reduces toner impaction and assists in enhancing the long term triboelectric properties of the developer. It is this which is believed to help in forming and maintaining good high density image quality while reducing background.

Contemplated abrasive materials include colloidal silica, surface modified organophilic silica, aluminum silicate, surface treated aluminum silicate, titanium dioxide, alumina, calcium carbonate, antimony trioxide, barium titanate, calcium titanate or strontium titanate, $CaSiO_3$, MgO, ZnO, $ZrO_2$ etc., and mixtures thereof.

The particularly preferred materials are these which have been surface modified to impart hydrophobic characteristics thereto. For example, hydrophobic silicas are prepared by reacting freshly prepared colloidal silica with at least one organosilicon compound having hydrocarbon groups as well as hydrolyzable groups attached to its silicon atom. In one technique, the reactants and steam are pneumatically introduced in parallel flow into a fluidized bed reactor heated to about 400° C. The organosilicon compound reacts with silanol groups on the surface of the $SiO_2$ particles and chemical attachment between the silicon atom in the organosilicon compound and the silicon atom in the $SiO_2$ occurs through an oxygen atom. Any suitable hydrocarbon or substituted hydrocarbon organic group directly attached to a silicon atom in the organosilicon compound may be employed in preparing the modified silica. The organic group is preferably one which imparts hydrophobic characteristics to the abrasive material to improve the stability of developer materials under varying humidity conditions. The organic groups may comprise saturated or unsaturated hydrocarbon groups or derivatives thereof. Saturated organic groups include methyl, ethyl, propyl, butyl, chloropropyl and chloromethyl groups. Examples of typical organosilicon compounds include: dimethyl dichlorosilane, trimethyl chlorosilane, methyl trichlorosilane, vinyl triethoxy silane. The type of organo groups can influence the triboelectric characteristics of the developer. For example, aminopropylsilane treated with silica can be used in a reversal type developer.

The particle size of the abrasive additive should a fall within the submicron range of from about 1 to about 500 millimicrons and preferably, between about 10 to about 100 millimicrons.

Concerning the comparative hardness of the abrasive type material, this material must be harder than both the toner material and the polymeric additive material. While most of the materials disclosed can be considered to be very hard materials falling within Mohs' hardness scale, it is to be understood that any material of less hardness than talc of Mohs' hardness scale can also be employed so long as it is harder than the toner material and polymeric additive material. Materials softer than talc are conveniently classified according to the Shore durometer penetration technique and placed within either scale A, B, C and D of this test procedure.

The chemical composition of the abrasive additive is not critical so long as it does not introduce deleterious contaminents or adversely affect the imaging and development aspects of an electrostatographic system. In addition, there is no particular criticality surrounding the shape of each abrasive particle since both spherical and irregularly shaped additives function effectively. Preferred materials are Aerosil R972, a hydrophobic silica available from DeGussa Incorporated, New York, N. Y. and Kaophile-2, a hydrophobic aluminum silicate, available from Georgia Kaolin Company Elizabeth, N. J.

The composition of the present invention finds utility in all known electrostatographic development systems. This includes systems which employ a carrier material such as magnetic brush development and cascade development as well as systems which do not necessarily employ a carrier material such as powder cloud development, fiber brush development and touchdown development.

Suitable coated and uncoated carrier materials and consumable carrier materials which are known, are useful with this invention.

Many typical carriers are described in U.S. Pat. No. 2,618,552. An ultimate coated particle diameter between about 50 microns to about 2000 microns is preferred because the carrier particles then possess sufficient density and inertia to avoid adherence to the electrostatic images during the cascade development process. Adherence of carrier beads to electrostatic drums is undesirable because of the formation of deep scratches on the surface during the image transfer and drum cleaning steps. Also, print deletion occurs when large carrier beads adhere to xerographic imaging surfaces. For magnetic brush development, carrier particles having an average particle size less than about 8000 microns are satisfactory. Generally speaking, satisfactory results are obtained when about 1 part toner is used with about 10 to about 1000 parts by weight of carrier in the cascade and magnetic brush developers.

Concerning the broad relative proportions of the toner material versus the additive materials, the polymeric additive material should be present in an amount of about 0.1 percent to about 10 percent by weight based upon the toner. A particularly preferred ratio is from about 0.1 percent to about 5 percent by weight of polymeric additive material based on the weight of toner.

Generally, it has been found that from about 0.01 percent to about 5 percent by weight of abrasive material based on the weight of the toner material will achieve the desired results. A particularly preferred range is from about 0.1 to about 1 percent by weight.

The toner compositions of the instant invention may be employed to develop electrostatic latent images on any suitable electrostatic latent image bearing surface including conventional photoconductive surfaces. Well known photoconductive materials include: vitreous selenium, organic or inorganic photoconductors embedded in a nonphotoconductive matrix, organic or inorganic photoconductors embedded in a photoconductive matrix or the like. Representative patents in which photoconductive materials are disclosed include: U.S. Pat. No. 2,803,542 to Ullrich, U.S. Pat. No. 2,970,906 to Bixby, U.S. Pat. No. 3,121,006 to Middleton, U.S. Pat. No. 3,121,007 to Middleton and U.S. Pat. No. 3,151,982 to Corrsin.

In U.S. Pat. No. 2,986,521, Wielicki, there is taught a reversal type developer powder for electrostatic printing comprising electroscopic material, i.e., toner, coated with a finely divided colloidal silica. The toner material must have (1) a positive triboelectric relationship with respect to the silica and (2) the silica coated toner must be repelled from negatively charged areas of an imaging surface. The only positively stated purpose or utility for the silica is to reduce tackiness and improve the free flowing characteristics of the developer powder.

In copending U.S. Ser. No. 31,353, filed on Apr. 23, 1970 in the name of Chatterji, it is taught that the inclusion at a minor proportion of similar polymeric additives in an electrostatic developer overcomes certain problems associated with the use of prior art toner materials.

In U.S. Pat. No. 3,522,850 issued to Stephen F. Royka et al., it is taught to employ a dry lubricant when employing a blade cleaner in an electrostatographic imaging system. This patent, however, does not teach the use of a combination of additives to control tribo and improve print density.

In U.S. Pat. No. 3,720,617 issued to Chatterji et al., it is taught to employ silica as an additive in an electrostatographic imaging system. This patent does not teach or recognize the enhance properties possible with the use of the additional polymeric additive of this invention.

In Ser. No. 188,570 filed Oct. 12, 1971, in the name of Jugle et al., it is taught to use a smearable additive and an abrasive to control the coating of the smearable additive on the photoreceptor during repeated cyclic imaging. This patent does not teach or recognize the enhance properties by using a nonsmearable additive in conjunction with an abrasive additive, nor does it recognize that toner impaction can be reduced by the unique technique given in this specification.

The following examples further define, describe and compare exemplary methods of preparing the development system components of the present invention and of utilizing them in a development and cleaning process. Parts and percentages are by weight unless otherwise indicated.

EXAMPLE I

The vitreous selenium drum of an automatic copying machine is corona charged to a positive voltage of about 800 volts and exposed to a light-and-shadow image to form an electrostatic latent image. The selenium drum is then rotated through a cascade development station. A control developer comprising 1 part toner having a critical surface tension value of about 30 dynes per centimeter and containing a styrene-butyl methacrylate copolymer and about 10 percent by weight carbon black is prepared by the method disclosed in Example I of U.S. Pat. No. 3,079,342 and about 100 parts steel core carrier beads prepared by the process disclosed in U.S. Pat. No. 2,618,551 is employed in the developer station. The toner particles have an average particle size of about 10 microns and the carrier beads have an average particle size of about 450 microns. After the electrostatic latent image is developed in the developing station, the resulting toner image is transferred to a sheet of paper at a transfer station. The residual toner particles remaining on the selenium drum after passage through the transfer station is removed by means of a cleaning blade comprising a rectangular strip of about 3/32 inch thick polyurethane elastomer having an edge spring biased against the photoreceptor surface. The trailing face of the cleaning blade is positioned to form an acute angle of about 22 with the line of tangency extending through the line of blade contact. Sufficient pressure is applied to the blade to obtain maximum removal of the toner particles from the drum surface. The drum surface is rotated at a surface speed of about 10 inches per second past the cleaning blade and 500 copies are made. After only a few copies are made, the copies and drum surface are examined for quality and condition, respectively, The copies made at the start and near the termination of the test are characterized by high background, streak marks, and irregular image density. Large portions of the drum are covered by a continuous toner film and occasional streaks and scratch marks. The electrical properties of the drum are measured and found to be erratic along the surface due to the toner deposits and scratches.

EXAMPLE II

The procedure of Example I is repeated under substantially the same conditions except that about 1 part of polyvinylidene fluoride particles and 0.25 part of hydrophobic silica are added to about 100 parts toner particles. The polyvinylidene fluoride (Kynar 201-Pennwalt Chemical Corporation) particles have a spherical shape, a particle size range from about 0.3 micron to about 0.4 micron, Shore D hardness (ASTM Test D676) of about 70–80 (Rockwell hardness 80–95). The silica is Aerosil R972. A fresh vitreous selenium drum is also substituted for the drum employed in Example I. After about 5,000 cycles, the copies, the drum surface, and the carrier particles are examined for quality and conditions, respectively. The copies formed throughout the test are characterized by high density print quality and substantially no background toner deposits. The electrical properties of the drum are measured and are found to exhibit substantially the same responses before and after the test. The drum surface shows no signs of toner-filming, streaks, or scratches. After long term use, the carrier triboelectric properties are xerographically enhanced over a sample without silica.

The expression "developer material" as employed herein is intended to include electroscopic toner material or combinations of toner material and carrier material.

Although specific materials and conditions are set forth in the foregoing examples, these are merely intended as illustrations of the present invention. Various other suitable toner components, additives, colorants and development techniques such as those listed above may be substituted for those in the examples with similar results. Other materials may also be added to the toner or carrier to sensitize, synergize or otherwise improve the imaging properties or other desirable of the system.

Other modifications of the present invention will occur to those skilled in the art upon a reading of the present disclosure. These are intended to be included within the scope of this invention.

What is claimed is:

1. An electrostatographic developing composition comprising particles; said particles including (1) finely divided electroscopic toner material, (2) a minor portion, based upon the weight of said toner material of a stable, tough, substantially smearless, polymeric additive having an average particle size less than about the average particle size of said finely divided toner material, and (3) a minor portion, based on the weight of said toner material, of a finely divided nonsmearable abrasive material of a hardness greater than said polymeric additive and said toner material.

2. The developing composition of claim 1 wherein the toner material has an average particle size of less than about 30 microns.

3. The developing composition of claim 1 wherein the abrasive material has an average particle size between about 1 millimicron and about 500 millimicrons.

4. The developing composition of claim 1 wherein said composition comprises from about 0.1 percent to about 10 percent by weight of said polymeric additive based upon the weight of said toner material; and from about 0.01 percent to about 5 percent by weight of said abrasive material based upon the weight of said toner.

5. The developing composition of claim 1 wherein said polymeric additive is more electronegative than sulfur in the triboelectric series.

6. The developing composition of claim 1 wherein said polymeric additive is polyvinylidene fluoride.

7. The developing composition of claim 1 wherein said polymeric additive comprises spherical particles.

8. The developing composition of claim 1 wherein said abrasive material comprises submicron size colloidal silica.

9. The developing composition of claim 8 wherein said silica is silicon dioxide particles having surface silicon atoms chemically attached through silicon-oxygen-silicon bonding to silicon atoms having one to three organic groups directly attached thereto by silicon-carbon bonding.

10. The developing composition of claim 1 including from 10 to 1000 parts by weight of carrier particles per part of toner material, said carrier particles being grossly larger than said finely divided toner material.

11. An electrostatographic developing composition comprising particles; said particles including (1) finely divided electroscopic resin toner material, (2) a minor portion, based upon the weight of said toner material of a stable, tough, substantially smearless, polymeric additive having an average particle size less than about the average particle size of said finely divided toner material, said polymeric additive particles of a resin other than the resin of said toner material, and (3) a minor portion, based on the weight of said toner material, of a finely divided nonsmearable abrasive material of a hardness greater than said polymeric additive and said toner material.

12. An electrostatographic developing composition comprising particles; said particles including (1) finely divided electroscopic toner material, (2) from about 0.1 to about 10 percent, based upon the weight of said toner material of a stable, tough, substantially smearless, polymeric additive selected from the group consisting of polyvinylidene fluoride, polytetrafluoroethylene, polychlorotrifluoroethylene, polyvinyl fluoride, polyvinylchloride, polyvinylidine chloride, polyethylene, polypropylene, chlorinated polyethylene, chlorinated polyether, copolymers of tetrafluoroethylene and chlorotrifluoroethylene, copolymers of tetrafluoroethylene and hexafluoropropylene, copolymers of tetrafluoroethylene and vinylidine fluoride, copolymers of chlorotrifluoroethylene and vinylidine fluoride, copolymers of vinyl chloride and vinyl fluoride, copolymers of vinyl chloride and polyethylene, copolymers of vinyl chloride and polypropylene, and mixtures of the same having an average particle size less than about the average particle size of said finely divided toner material and (3) from about 0.01 to about 5 percent based upon on the weight of said toner material, of a finely divided nonsmearable abrasive material of a hardness greater than said polymeric additive and said toner material.

13. A dry developer composition for electrostatographic image development comprising a toner of finely divided particles of a resin, an additive in an amount of from 0.1 to about 10 percent by weight of said toner of particles of a synthetic resin other than the resin of said toner, and an abrasive in an amount of from about 0.01 to about 5 percent by weight of said toner, said particles of additive and abrasive having an average size smaller than that of said toner particles, said particles of additive being at least one synthetic resin selected from the group consisting of polyvinylidene fluoride, polytetrafluoroethylene, polychlorotrifluoroethylene, polyvinyl fluoride, polyvinylchloride, polyvinylidine chloride, polyethylene, polypropylene, chlorinated polyethylene, chlorinated polyether, copolymers of tetrafluoroethylene and chlorotrifluoroethylene, copolymers of tetrafluoroethylene and hexafluoropropylene, copolymers of tetrafluoroethylene and vinylidine fluoride, copolymers of chlorotrifluoroethylene and vinylidine fluoride, copolymers of vinyl chloride and finyl fluoride, copolymers of vinyl chloride and polyethylene, copolymers of vinyl chloride and polypropylene, and mixtures of the same, and said particles of abrasive being selected from the group consisting of colloidal silica, surface modified organophilic silica, aluminum silicate, surface treated aluminum silicate, titanium dioxide, alumina, calcium carbonate, antimony trioxide barium titanate, calcium titanate, strontium titanate, $CaSiO_3$, MgO, ZnO, $ZrO_2$, and mixtures thereof.

* * * * *